US005857928A

United States Patent [19]

Stewart

[11] Patent Number: 5,857,928

[45] Date of Patent: Jan. 12, 1999

[54] PORTABLE SOCCER PRACTICE GOAL NET

[76] Inventor: Thomas Edward Stewart, 1 Jeffrey St., Brampton, Ontario, Canada, L6S 2M9

[21] Appl. No.: 869,505

[22] Filed: Jun. 5, 1997

[51] Int. Cl.[6] ..... A63B 63/04

[52] U.S. Cl. ..... 473/446; 273/400; 473/478

[58] Field of Search ..... 473/446, 478, 473/212; 273/400

[56] References Cited

U.S. PATENT DOCUMENTS 4,664,384 5/1987 Solla ..... 473/478

OTHER PUBLICATIONS

"Net Big Profits With Nessie", Published by New England Sports Sales, Inc. Date Not Known.

I•T•S•A ™ Goal Trade Pack Copyright 1989, John Wilson. Your Source For The Most Advanced Soccer Goals Published by Xsell Sports Date Not Known.

Fold–A–Goal Everything For Soccer, pp. 3–7, and 9–15 Published by D. Hauptman Co., Inc. Date Not Known.

Product Catalogue, pp. 53 Through 60 Published by Riley–Meggs Industries, a Division of 953448 Ontario Inc. Date Not Known.

Introducing The Fold Up "Recreational Hockey Goal Frame" Published by Riley–Meggs Industries, A Division of 953448 Ontario Inc. No Date.

Kwikgoal 1997 Full Line Soccer Equipment, pp. 4–27, 31, and 34–35, Published by Kwik Goal Ltd. Dec. 1997.

"Proposed Guidelines For Moveable Soccer Goal Safety", Published May 1997 by Product Safety Bureau, Health Canada May 1997.

*Primary Examiner*—William H. Grieb

*Attorney, Agent, or Firm*—Donald E. Hewson

[57] ABSTRACT

A sports goal comprises a goal frame, including substantially vertically oriented first and second goal posts each having a top end and a bottom end and a cross-bar interconnecting the first and second goal posts at their respective top ends. The bottom ends of the first and second goal posts define a goal line spanning therebetween. A ground contacting base is connected to the first and second goal posts at respective first and second fixed points adjacent the bottom ends of the first and second goal posts, so as to securely interconnect the first and second goal posts. The ground contacting base extends rearwardly behind the goal line to provide upright stability for the sports goal. The first and second goal posts are tiltably movable between a upright position and an impacted position disposed angularly rearwardly of the upright position. A net is secured to the goal frame and the ground contacting base. There are first and second support arms each having a first end and a second end, with the first and second support arms being mounted at their first ends on the ground contacting base and mounted at their second ends in slidable relation on the first and second goal posts, respectively, for sliding movement between a respective lower position and a respective upper position when the first and second goal posts are forced by impact of an object from their respective upright positions toward their respective impacted position.

20 Claims, 4 Drawing Sheets

PORTABLE SOCCER PRACTICE GOAL NET

FIELD OF THE INVENTION

This invention relates to sports goals used in sports such as soccer, hockey, lacrosse, and so on, and more particularly to portable sports goals for use during the play and practice of such sports. Specifically, a lightweight, safe portable sports goal is disclosed.

BACKGROUND OF THE INVENTION

In many sports, such as soccer, indoor soccer, hockey, ball hockey, field hockey, and lacrosse, and the like, projectiles are kicked, shot, flung, and otherwise propelled, at two opposed goals, with each goal being guarded by a goal keeper. Often, a considerable amount of the play of the game takes place around the two goals, with significant numbers of players, in addition to the goal keeper, frequently being quite close to the goal, or even in contact with the goal. Accordingly, it is not uncommon for a player to collide with a goal, thus potentially injuring himself or herself. Indeed, many injuries occur as a result of collisions with a goal, in the above mentioned sports.

While it would be quite beneficial to have sports goals that are designed to not injure a player who has collided with the goal, such sports goals may be inappropriate from other standpoints. A sports goal must be robust enough to withstand the impact of a person colliding therewith so that the goal structure does not break. Further, the sports goal must be robust enough to withstand the impact of projectiles, such as soccer balls, field hockey balls, lacrosse balls, hockey pucks, and so on, which might be travelling at speeds well in excess of one hundred kilometers per hour, in some instances. Typically, soccer goals must withstand the greatest impact of any sports goal. Even though soccer balls typically do not travel as fast as hockey pucks or lacrosse balls might, soccer balls are several times heavier, and therefore have a considerable amount of kinetic energy. Accordingly, soccer goals, even many portable soccer goals, which are commonly used for practice, are typically quite robust and heavy, which leads to potential injuries.

Moreover, another problem with portable soccer goals is that in addition to being robust enough to withstand the impact of soccer balls, they also may be quite large, up to nearly four meters by two meters, and are therefore quite heavy. Many portable soccer goals weigh an excess of fifty pounds, or even more, and perhaps over one hundred pounds. In order to help minimize the weight of such soccer goals, it is common to make the feet and other frame portions that extend rearwardly of the goal posts and cross-bar, as lightweight as reasonably possible. The goal posts and cross-bar, however, are quite substantial and quite heavy in order to have overall structural rigidity and to withstand the impact of players and also objects such as soccer balls, hockey pucks, and the like. Accordingly, these nets tend to be unstable and can easily tip forwardly in a wind or if a player tries to hang from the cross-bar. Since these nets are quite heavy, such tipping forward is quite dangerous. Many severe injuries have been caused by large portable sports goals tipping over on players; and several deaths have also occurred in the last few years.

Various attempts have been made to produce safe, lightweight, portable soccer goals. Typically, such portable soccer goals, and other portable sports goals, are made from plastic or lightweight metal tubing and have two goal posts adjoined by a cross-bar, and two feet extending rearwardly one from each goal post and adjoined by a rear cross-member, all forming a ridged unyielding structure. Without exception, safe, lightweight prior art portable soccer goals are not sufficiently robust, and have been found to break after a relatively brief period of use, due to the substantial impact of soccer balls.

Prior art portable sports goals, as described above, are generally considered unacceptable, and accordingly it is common to use rubber or plastic pylons in place of a goal. Such use of pylons is undesirable as the height of the goal is undefined, and the width of the goal is not predetermined and may easily be altered. Further, the goal keeper does not gain the experience of actually seeing and feeling where the goal posts and cross-bar are during play.

It is an object of the present invention to produce a sports goal that is safe for use and can withstand the impact of projectiles and players, yet is safe and lightweight.

SUMMARY OF THE INVENTION

In accordance with one aspect of the present invention, there is provided a sports goal comprising a goal frame, including substantially vertically oriented first and second goal posts each having a top end and a bottom end and a cross-bar interconnecting the first and second goal posts at their respective top ends. The bottom ends of the first and second goal posts define a goal line spanning therebetween. A ground contacting base is connected to the first and second goal posts at respective first and second fixed points adjacent the bottom ends of the first and second goal posts, so as to securely interconnect the first and second goal posts. The ground contacting base extends rearwardly behind the goal line to provide upright stability for the sports goal. The first and second goal posts are tiltably movable between an upright position and an impacted position disposed angularly rearwardly of the upright position. A net means is secured to the goal frame and the ground contacting base. There are first and second support arms each having a first end and a second end, with the first and second support arms being mounted at their first ends on the ground contacting base and mounted at their second ends in slidable relation on the first and second goal posts, respectively, for sliding movement between a respective lower position and a respective upper position when the first and second goal posts are forced by impact of an object from their respective upright positions toward their respective impacted position.

In accordance with another aspect of the present invention, there is provided a sports goal comprising a goal frame, including substantially vertically oriented first and second goal posts each having a top end and a bottom end and a cross-bar interconnecting the first and second goal posts at their respective top ends. The bottom ends of the first and second goal posts define a goal line spanning therebetween. A ground contacting base is connected to the first and second goal posts at respective first and second fixed points adjacent the bottom ends of the first and second goal posts, so as to securely interconnect the first and second goal posts. The ground contacting base extends rearwardly behind the goal line to provide upright stability for the sports goal. The first and second goal posts are tiltably movable between a upright position and an impacted position disposed angularly rearwardly of the upright position. A net means is secured to the goal frame and the ground contacting base. There are first and second support arms each having a first end and a second end, with the first and second support arms being mounted at their first ends on the ground contacting base and mounted at their second ends on the first and second goal posts, respectively. An impact absorbing means is operatively mounted between the first end of the first and second support arms and the ground contacting base. The first and second support arms and the impact absorbing means together support the first and second goal posts in force absorbing relation, respectively, when the first and second goal posts are forced by impact of an object from their respective upright positions toward their respective impacted positions.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

Figure 1:
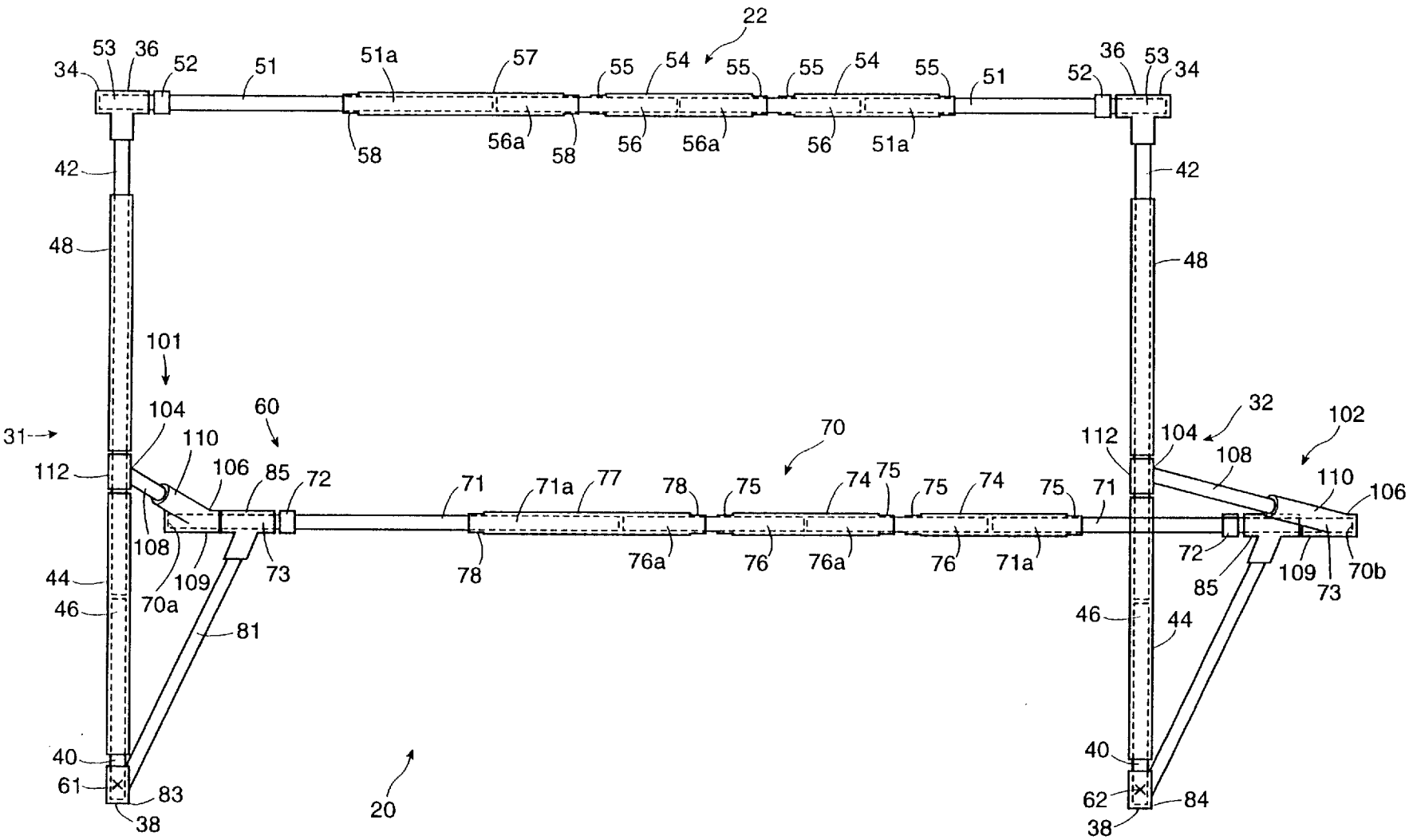
FIG. 1 is a perspective view from the front of the preferred embodiment of the sports goal according to the present invention, with the goal net removed for the sake of clarity.
Figure 2:
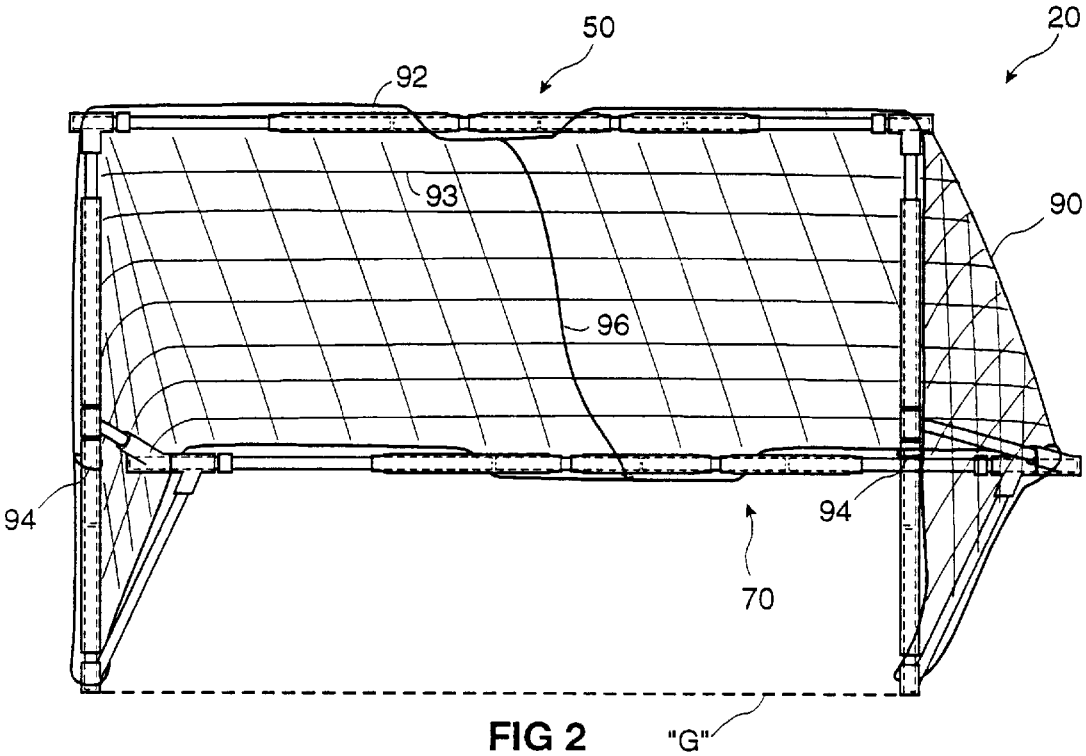
FIG. 2 is a perspective view from the front of the sports goal of FIG. 1, with the goal net in place.

Reference will now be made to FIGS. 1 through 5, which illustrate the sports goal of the present invention, as indicated by the general reference numeral 20. The sports goal 20 comprises a goal frame, as indicated by the general reference numeral 22, through which projectiles, such as soccer balls, field hockey balls, lacrosse balls, hockey pucks, and so on, are passed to score a goal. The goal frame 22 includes substantially vertically oriented first and second goal posts, as indicated by the general reference numerals 31 and 32, respectively. The first and second goal posts 31 and 32 are substantially identical one to the other, and similar parts on each of the first and second goal posts 31 and 32 will be indicated by like reference numerals. Each of the first and second goal posts 31 and 32 has a top end 34 with a substantially horizontally oriented collar 36 disposed thereat, and a bottom end 38 having a reduced diameter portion 40. The first and second goal posts 31 and 32 may range from about four feet in height to about eight feet in height, with a common height for a portable soccer net, typically used for practice, being about six feet or seven feet. The bottom ends 38 of the first and second goal posts 31 and 32 define a goal line "G" spanning therebetween, as can be seen in FIG. 2. In the preferred embodiment, the first and second goal posts 31 and 32 each comprise a piston member 42 loosely slidably engaged in a cylinder member 44 for sliding movement between a first retracted position and a second extended position, thus permitting the goal frame 22 to more easily absorb the impact of an object, as will be discussed in greater detail subsequently. The piston members 42 rest on an internal abutment member 46 in the respective cylinder members 44, directly above the reduced diameter portion 40. Also, the piston members 42 are removable from the cylinder members 44 for the purpose of disassembly for convenient carrying of the sports goal 20.

In the preferred embodiment, each of the piston members 42 is of a slightly smaller diameter than the interior diameter of the cylinder members 44, so that the piston members 42 fit in loose sliding relation into the respective cylinder members 44. Accordingly, the piston members 42 are less strong than the cylinder members 44. In order to protect the piston members 42 and preclude unwanted breakage thereof due to the impact of an object, each of the first and second goal posts 31 and 32 further comprises an annular cylindrical protective sheath 48 loosely mounted in surrounding relation around the piston members 42. Preferably, the annular cylindrical protective sheathes 48 are shorter in length than the distance between the top of the cylinder member 44 and the collar 36 at the top of the goal post 31 and 32, so as to permit vertical sliding of the protective sheathes 48, as will be discussed in greater detail subsequently.

The goal frame 22 also includes a cross-bar, as indicated by the general reference numeral 50, interconnecting the first and second goal posts 31 and 32 at their respective top ends 34. The cross-bar 50 may range from about six feet in length to about sixteen feet in length, with a common size for a portable soccer goal, typically used for practice, being about twelve feet. Full size soccer goals having a width of twenty-four feet may even be constructed. In the preferred embodiment, the cross-bar comprises two end members 51 of a reduced diameter and having an annular collar 52 disposed thereon at a distance from one end of the collar 52 approximately equal to the length of the substantially horizontally oriented collar 36 of the goal posts 31 and 32, so as to define a male end portion 53 that is removably inserted into the end collar 36. A first extension member 54 having a female end portion 55 and an internal abutment member 56 that extends outwardly to a male end portion 56*a*, is received at its female end portion 55 on one of the end members 51, so as to surround an end portion 51*a* thereof, such that the end portion 51*a* abuts against the male end portion 56*a*. A second essentially identical, and therefore interchangeable, extension member 54 is received at its female end portion 55 on the male end portion 56*a* of the first extension member 54, such that the male end 56*a* of the first extension member 54 abuts against the internal abutment member 56 of the second extension member 54. The male end portion 56*a* of the second extension member 54 abuts against the end portion 51*a* of the second end member 51. A coupling member 57 having two female end portions 58 adjoins the male end portion 56*a* of the second extension member 54 and the second end member 51 in surrounding relation. It can be seen that the number of extension members 54 used will determine the length of the cross-bar 50, and thus partially determine the width of the sports goal 20.

The sports goal 20 further comprises a substantially "U"-shaped ground contacting base, as indicated by the general reference numeral 60, which ground contacting base securely interconnects the first and second goal posts 31 and 32. The ground contacting base 60 is connected to the first and second goal posts 31 and 32 at respective first and second fixed points 61 and 62 adjacent the bottom ends 38 of the first and second goal posts 31 and 32, respectively. It can be seen that the substantially "U"-shaped ground contacting base 60 extends rearwardly behind the goal line to provide upright stability for the sports goal 20.

The "U"-shaped ground contacting base 60 includes an elongate rear cross-member, as indicated by the general reference numeral 70, having first and second ends 70*a* and 70*b*. The base 60 is substantially the same length as the cross-bar 50 of the goal frame 22, and is disposed in substantially parallel relation to the cross-bar 50.

Figure 3:
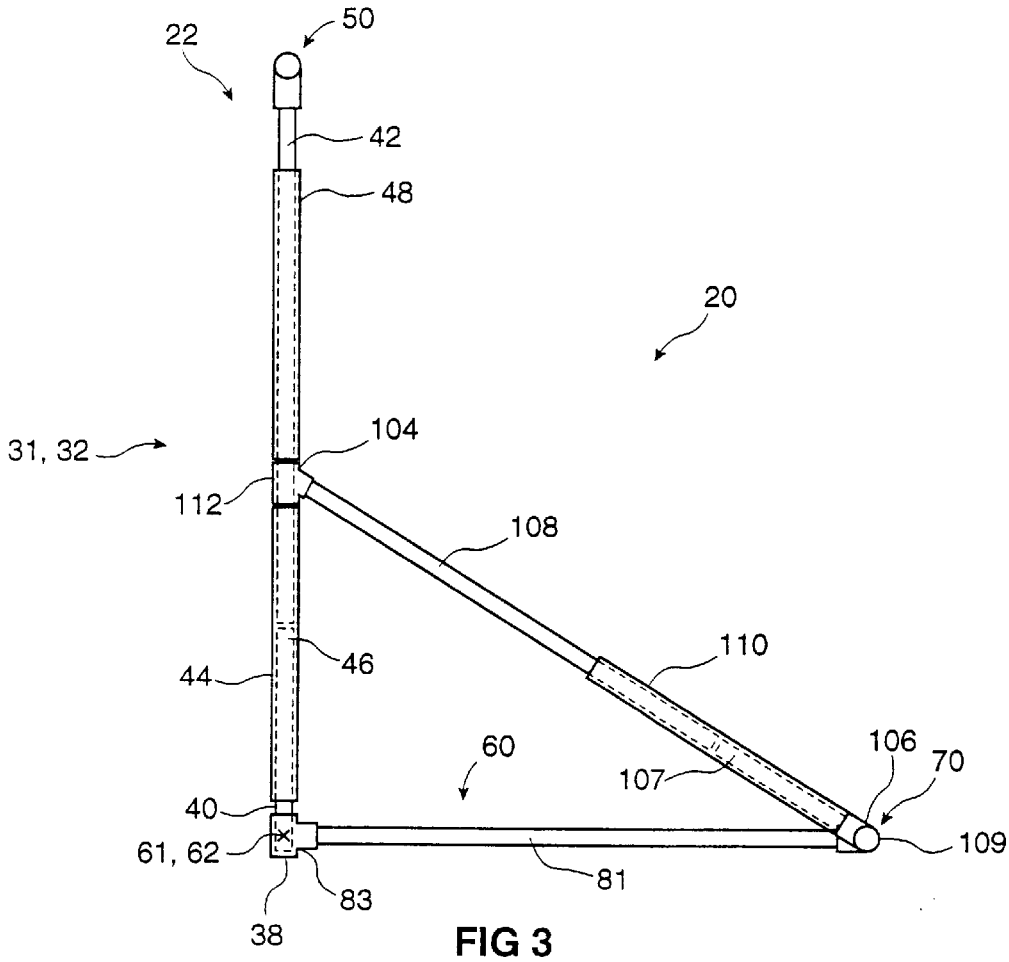
FIG. 3 is a side elevational view of the sports goal of FIG. 1, with the goal posts in an upright position.

First and second foot members 81 and 82 are pivotally mounted on the rear cross-member 70, one adjacent each of the first and second ends 70*a* and 70*b* of the rear cross-member 70 by means of a substantially horizontally oriented collar 85, so as to extend forwardly from the rear cross-member 70. The first and second foot members 81 and 82 are substantially identical one to the other, and similar parts on each of the first and second foot members 81 and 82 are indicated by like reference numerals. The first and second foot members 81 and 82 terminate in first and second sockets 83 and 84, respectively, which first and second sockets 83 and 84 are disposed at the first and second fixed points 61 and 62, respectively. The first and second sockets 83 and 84 are substantially vertically oriented and are adapted to receive the reduced diameter bottom ends 38 of the cylinder members 44 of the respective goal posts 31 and 32 therein, such that the first and second goal posts 31 and 32 are supported in their substantially vertical upright positions. The first and second goal posts 31 and 32 are removably mounted in loose fitting relation in the first and second sockets 83 and 84, respectively, in so as to be tiltably movable between their respective upright positions, as shown in FIG. 3, and impacted positions, as shown in FIGS. 4 and 5, which impacted positions are disposed angularly rearwardly of the respective upright position, thereby helping to absorb the kinetic energy of an object impacting the sports goal 20, thus precluding breakage of the sports goal 20.

Figure 4:
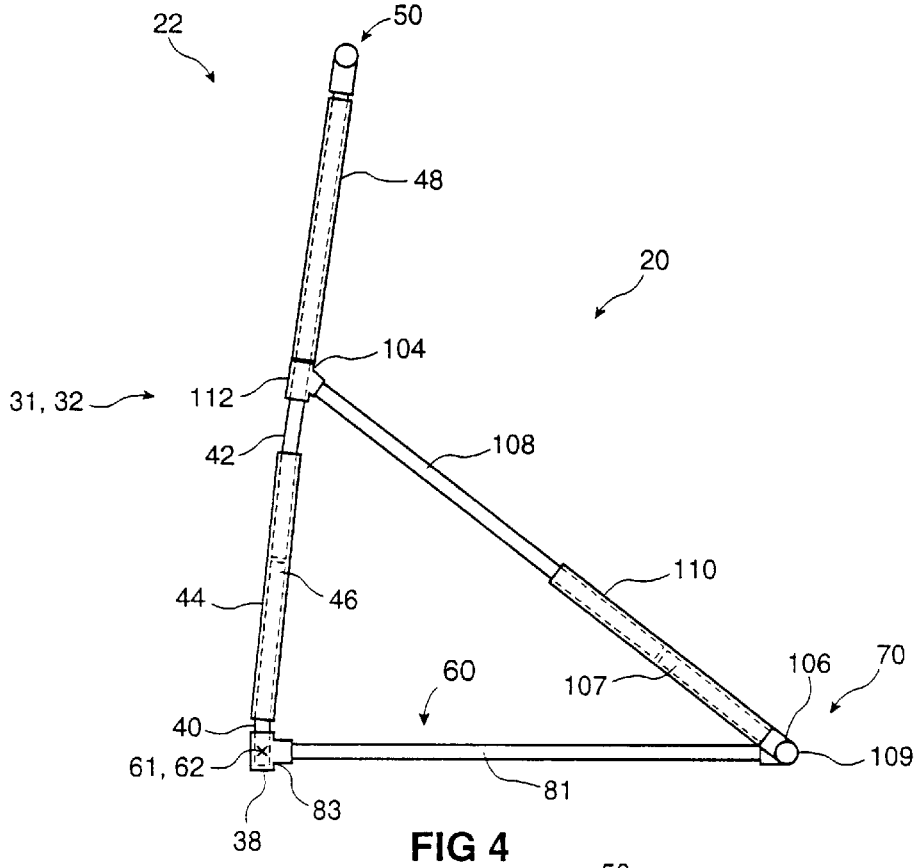
FIG. 4 is a side elevational view of the sports goal of FIG. 1, with the goal posts in an impacted position.
Figure 5:
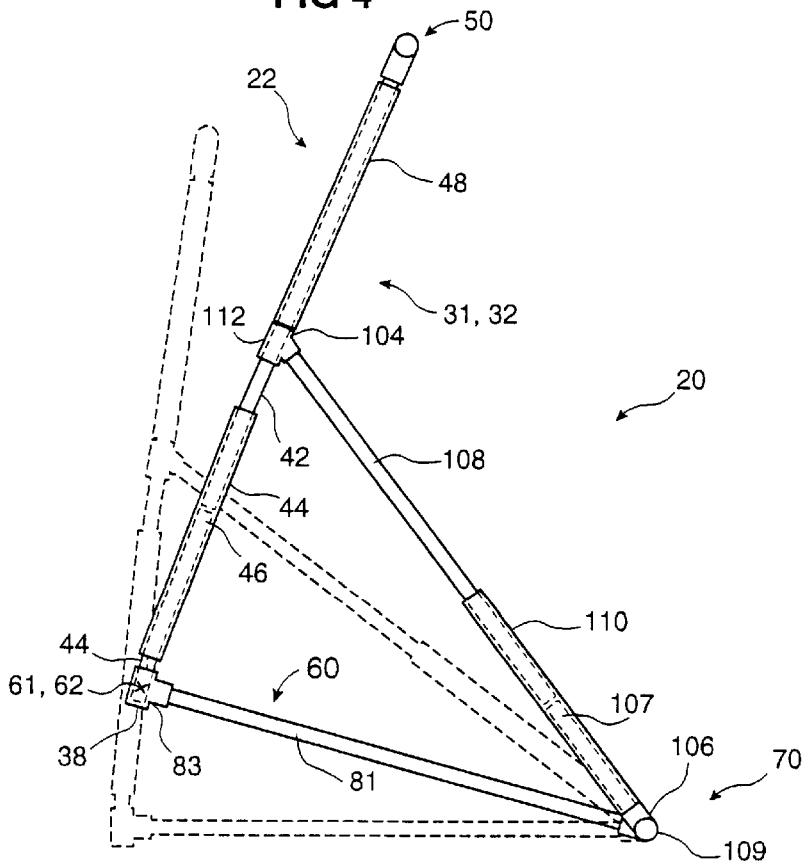
FIG. 5 is a side elevational view of the sports goal of FIG. 1, with the goal posts in an impacted position and with the foot members partially lifted off the ground.

Additionally, another reason the piston members 42 of the first and second goal posts 31 and 32 are each loosely engaged in the respective cylinder member 44, as discussed above, is to permit rearward angular movement upon impact of an object on the piston member 42 of either of the goal posts 31 and 32, as shown in FIG. 4, thus further helping to absorb the kinetic energy of an object impacting the sports goal 20, thereby precluding breakage of the sports goal 20.

As is shown in FIG. 2, a net means in the form of a goal net 90 comprising a peripheral looped cord 92 spanned by a suitable mesh 93 is draped over and around the goal frame 22 and the ground contacting base 60 in surrounding relation thereto. The goal net 90 is secured to the goal frame 22 by ties 94 at each of the first and second goal posts 31 and 32 and by an elongate tie 96 extending from the peripheral looped cord 92 at the top centre of the cross-bar 50 and releasably tied to the peripheral looped cord 92 at the bottom centre of the rear cross-member 70 of the ground contacting base 60. The portion of the goal net 90 at the top centre of the cross-bar 50 is displaced under and then wrapped over the cross-bar 50 and the portion of the goal net 90 at the bottom centre of the rear cross-member 70 is displaced under and then wrapped over the rear cross-member 70 in order to permit the goal net 90 to more snugly secured to the goal frame 22 and the ground contacting base 60.

Spanning between each of the first and second foot members 81 and 82 and the respective adjacent goal post 31, 32, are first and second support arms, as indicated by the general reference numerals 101 and 102, respectively, with each of the support arms 101 and 102 having a front end 104 and a back end 106. The first and second support arms 101 and 102 are substantially identical one to the other, and similar parts on each of the first and second support arms 101 and 102 are indicated by like reference numerals. In the preferred embodiment, the first and second support arms 101 and 102 each comprise a piston member 108 disposed toward the front end 104 of the first and second support arms 101 and 102 and each slidably engaged in a respective cylinder member 110 disposed toward the back end 106 of the first and second support arms 101 and 102, for sliding movement of the piston member 108 between a retracted position and an extended position. The piston members 108 rest on respective internal abutment members 107 disposed one in each cylinder member 110.

The front end 104 of each of the first and second support arms 101 and 102 comprises a collar portion 112 disposed in slidable surrounding relation around the piston members 42 of the respective of the first and second goal posts 31 and 32, for sliding movement of the collar portion 112 between a respective lower position, as is best seen in FIG. 3, and a respective upper position, as is best seen in FIG. 4, when the first and second goal posts 31 and 32 are forced by impact of an object from their respective upright positions toward their respective impacted positions.

The back end 106 of each of the first and second support arms 101 and 102 is pivotally mounted on the rear cross-member 70 of the "U"-shaped ground contacting base 60 by means of a substantially horizontally oriented collar 109, so as to permit the support arms 101 and 102 to move angularly such that the collar portion 112 at the front end 104 is permitted to slide between its upper and lower positions. Also, the piston members 108 are removable from the cylinder members 110 for the purpose of disassembly for convenient carrying of the sports goal 20.

In the preferred embodiment, the rear cross-member 70 comprises two end members 71 of a reduced diameter and having an annular collar 72 disposed thereon at a distance from one end of the collar 72 approximately equal to the length of the substantially horizontally oriented collar 85 of the first and second foot members 81 and 82 plus the length of the substantially horizontally oriented collar 109 of the first and second support arms 101 and 102, so as to define a male end portion 73 that is removably inserted into the two end collars 85 and 109. A first extension member 74 having a female end portion 75 and an internal abutment member 76 that extends outwardly to a male end portion 76*a*, is received at its female end portion 75 on one of the end members 71, so as to surround an end portion 71*a* thereof, such that the end portion 71*a* abuts against the male end portion 76*a*. A second essentially identical, and therefore interchangeable, extension member 74 is received at its female end portion 75 on the male end portion 76*a* of the first extension member 74, such that the male end 76*a* of the first extension member 74 abuts against the internal abutment member 76 of the second extension member 74. The male end portion 76*a* of the second extension member 74 abuts against the end portion 71*a* of the second end member 71. A coupling member 77 having two female end portions 78 adjoins the male end portion 76*a* of the second extension member 74 and the second end member 71 in surrounding relation. It can be sen that the number of extension members 74 used will determine the length of the rear cross-member 50, and thus partially determine the width of the sports goal 20.

In the preferred embodiment, the ground contacting base 60, the goal frame 22, and the first and second support arms 101 and 102 are made from a substantially rigid slightly flexible plastic material, such as ABS. Further, these parts are preferably, but not necessarily, cylindrical in shape for the purposes of simplicity of manufacture and assembly.

In use, if an object impacts the goal frame 22 or the goal net 90, as would a soccer ball being kicked at the sports goal 20, the various components of the goal net 90 move in the following manner to help absorb the impact of the impacting object. The goal posts 31 and 32 move angularly in the first and second sockets 83 and 84 from their respective upright positions, shown in FIG. 3, and impacted positions, shown in FIG. 4. The piston members 42 of the goal posts 31 and 32 move angularly rearwardly in the respective cylinder members 44. The first and second support arms 101 and 102 move angularly upwardly, with the end collars 109 pivoting about the rear cross-member 70, such that the collar portions 112 slide vertically upwardly from their respective lower positions to their respective upper positions on the goal posts 31 and 32. The collar portions 112 push the annular cylindrical protective sheathes 48 upwardly since the annular cylindrical protective sheathes 48 are shorter in length than the distance between the top of the cylinder member 44 and the collar 36 at the top of the goal post 31 and 32, until the protective sheathes 48 abut against the substantially horizontally oriented collars 36. If sufficient impact has occurred by an object against the goal frame 22, the piston members 42 may slide upwardly with respect to the cylinder members 44, from their first retracted positions to their second extended positions, and ultimately the entire goal posts 31 and 32 may be lifted upwardly, as is shown in FIG. 5. The first and second foot members 81 and 82 would correspondingly be move angularly upwardly, with the end collars 109 pivoting about the rear cross-member 70. Further, as the goal posts 31 and 32 return from their respective impacted positions to their upright positions, the cylinder members 44 slide downwardly with respect to the respective piston members 42, and thereby further lengthen, until the collar portions 112 of the first and second support arms 101 and 102 slide vertically downwardly from their respective upper positions to their respective lower positions.

Figure 6:
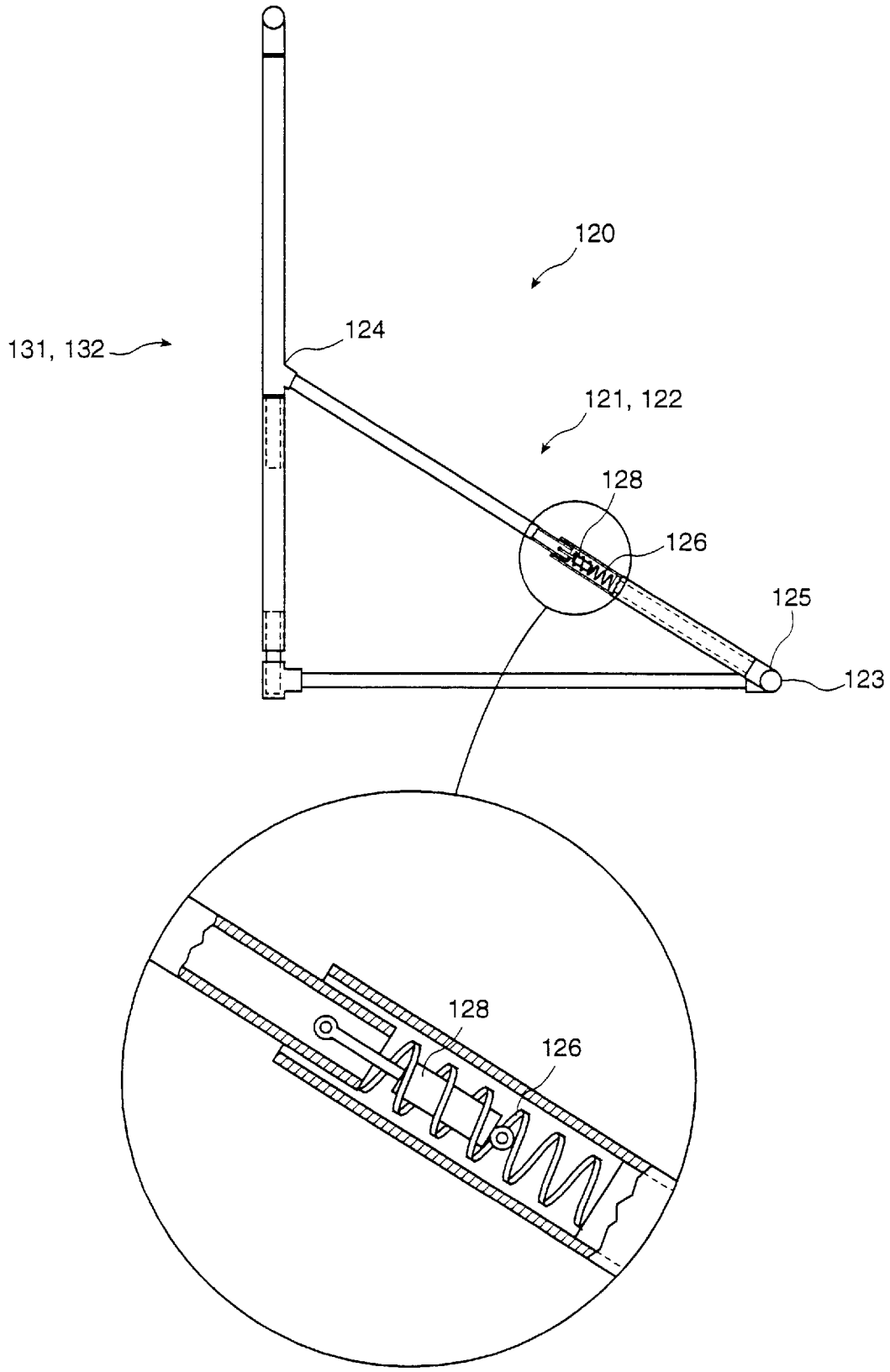
FIG. 6 is a side elevational view of a portion of an alternative embodiment of the sports goal according to the present invention, with the goal net removed for the sake of clarity.

Reference will now be made to FIG. 6, which shows an alternative embodiment of the sports goal of the present invention, as indicated by the general reference numeral 120. The alternative embodiment sports goal 120 is essentially similar to the preferred embodiment sports goal 20, except for the omission of the slidable collar portions 112 from the first and second support arms, as indicated by the general reference numerals 121 and 122, respectively, which support arms 121 and 122 are essentially identical one to the other. The front ends 124 of the first and second support arms 121 and 122 are securely attached in fixed non-sliding relation to the respective first and second goal posts 131 and 132. Impact absorbing means comprising a spring member 126 and a damper member 128 are operatively mounted between the front ends 124 of the first and second support arms 121 and 122 and the ground contacting base 60, at ends 123 of each arm. The first and second support arms 121 and 122 and the impact absorbing means, namely the spring member 126 and the damper member 128 together support the first and second goal posts 131 and 132 in force absorbing relation, respectively, when the first and second goal posts 131 and 132 are forced by impact of an object from their respective upright positions toward their respective impacted positions.

In another alternative embodiment of the present invention, not shown, it is contemplated that various components of the sports goal 20, such as all of the components of the rear cross-member 70, for instance, could be tied one to another by means of an internal cord extending the length of all of the components. In this manner, all of the components of the rear cross-member 70, for instance, are kept together in their proper end-to-end relation, when the components are disassembled, so as to make for more quick and convenient assembly and also helping to preclude the loss of parts.

In yet a further alternative embodiment of the present invention, not shown, it is contemplated that a goal net would have an elongate tie, similar to the elongate tie 96 disclosed in the preferred embodiment, but made from an elastic type of material, such as that typically used in a "bungee" cord, thus tensioning the peripheral looped cord of he goal net.

In yet another alternative embodiment of the present invention, not shown, it is contemplated that a goal net would have a peripheral looped cord that is made from an elastic type of material, such as that typically used in a "bungee" cord, thus potentially eliminating the need for an elongate tie.

The sports practice goal of the present invention, as described above, is generally meant for use as a practice goal, and is not necessarily meant for official league play, except possibly for younger children who may not play on a full size soccer pitch, or who may require soccer goals that are smaller than regulation size. It is common to establish a temporary soccer pitch, for either practice or play by younger individuals, in a common area of a park, a football field, or the like. In this case, use of the sports goal of the present invention is quite appropriate and convenient. It is possible to temporarily make any suitable open field into a temporary soccer pitch, thereby increasing the number of temporary soccer pitches, for practice and possibly games, available to a league, thereby potentially also reducing costs of building practice fields.

The above description teaches a typical sports goal according to the present invention, which sports goal is a multi-part structure that can be quickly and easily assembled and disassembled in minutes, is compact enough to carry in a trunk of a car, even a sub-compact car. The sports goal as taught typically weighs only about thirty to forty pounds, and is therefore easy and convenient to transport about. Also the sports goal as taught quite safe, yet can withstand the impact of players, soccer balls, field hockey balls, and the like. These above discussed advantages cannot be found in prior art sports nets.

Other modifications and alterations may be used in the design and manufacture of the apparatus of the present invention without departing from the spirit and scope of the accompanying claims.

What is claimed is:

1. A sports goal comprising:

a goal frame, including substantially vertically oriented first and second goal posts each having a top end and a bottom end and a cross-bar interconnecting said first and second goal posts at their respective top ends, wherein the bottom ends of said first and second goal posts define a goal line spanning therebetween;

a ground contacting base connected to said first and second goal posts at respective first and second fixed points adjacent said bottom ends of said first and second goal posts, so as to securely interconnect said first and second goal posts, wherein said ground contacting base extends rearwardly behind said goal line to provide upright stability for said sports goal;

wherein said first and second goal posts are tiltably movable between an upright position and an impacted position disposed angularly rearwardly of said upright position;

net means secured to said goal frame and said ground contacting base; and first and second support arms each having a first end and a second end, with said first and second support arms being mounted at their first ends on said ground contacting base and mounted at their second ends in slidable relation on said first and second goal posts, respectively, for sliding movement between a respective lower position and a respective upper position when said first and second goal posts are forced by impact of an object from their respective upright positions toward their respective impacted position.

2. The sports goal of claim 1, wherein said ground contacting base is substantially "U"-shaped.

3. The sports goal of claim 2, wherein said ground contacting base has first and second sockets disposed at the respective first and second fixed points, with said first and second goal posts being removably mounted in said first and second sockets, respectively.

4. The sports goal of claim 3, wherein each of said first and second goal posts are loosely mounted in said first and second sockets, respectively, so as to be displaceable between their respective upright positions and impacted positions.

5. The sports goal of claim 4, wherein said "U"-shaped ground contacting base includes an elongate rear cross-member disposed in substantially parallel relation to said cross-bar having first and second ends and first and second foot members pivotally mounted on said rear cross-member, one adjacent each end of said rear cross-member.

6. The sports goal of claim 5, wherein said second end of each of said first and second support arms comprises a collar portion disposed in slidable surrounding relation around the respective of said first and second goal posts.

7. The sports goal of claim 6, wherein said first end of each of said first and second support arm is pivotally mounted on said rear cross-member of said "U"-shaped ground contacting base.

8. The sports goal of claim 7, wherein said first and second support arms each comprise a piston member disposed toward said second end of said first and second support arms and each slidably engaged in a respective cylinder member disposed toward said first end of said first ends second support arms, for sliding movement of the piston member between a retracted position and an extended position.

9. The sports goal of claim 1, wherein said first and second goal posts each comprise a piston member loosely slidably engaged in a cylinder member for sliding movement between a first retracted position and a second extended position and to permit rearward angular movement upon impact of an object on said piston member of said goal post.

10. The sports goal of claim 9, further comprising an annular cylindrical protective sheath disposed in surrounding relation around said piston member of said goal post.

11. The sports goal of claim 1, wherein said ground contacting base, said goal frame, and said first and second support arms are made from substantially rigid slightly flexible plastic material.

12. A sports goal comprising:

a goal frame, including substantially vertically oriented first and second goal posts each having a top end and a bottom end and a cross-bar interconnecting said first and second goal posts at their respective top ends, wherein the bottom ends of said first and second goal posts define a goal line spanning therebetween;

a ground contacting base connected to said first and second goal posts at respective first and second fixed points adjacent said bottom ends of said first and second goal posts, so as to securely interconnect said first and second goal posts, wherein said ground contacting base extends rearwardly behind said goal line to provide upright stability for said sports goal;

wherein said first and second goal posts are tiltably movable between a upright position and an impacted position disposed angularly rearwardly of said upright position;

net means secured to said goal frame and said ground contacting base; and first and second support arms each having a first end and a second end, with said first and second support arms being mounted at their first ends on said ground contacting base and mounted at their second ends on said first and second goal posts, respectively;

impact absorbing means operatively mounted between said first end of said first and second support arms and said ground contacting base;

wherein said first and second support arms and said impact absorbing means together support said first and second goal posts in force absorbing relation, respectively, when said first and second goal posts are forced by impact of an object from their respective upright positions toward their respective impacted positions.

13. The sports goal of claim 12, wherein said ground contacting base is substantially "U"-shaped.

14. The sports goal of claim 13, wherein said ground contacting base has first and second sockets disposed at the respective first and second fixed points, with said first and second goal posts being removably mounted in loose fitting relation in said first and second sockets, respectively so as to be displaceable between their respective upright positions and impacted positions.

15. The sports goal of claim 12, wherein said "U"-shaped ground contacting base includes an elongate rear cross-member disposed in substantially parallel relation to said cross-bar having first and second ends and first and second foot members mounted on said rear cross-member, one adjacent each end of said rear cross-member.

16. The sports goal of claim 12, wherein said impact absorbing means comprises a spring member.

17. The sports goal of claim 12, wherein said impact absorbing means further comprises a damper member.

18. The sports goal of claim 12, wherein said first and second goal posts each comprise a piston member slidably engaged in a cylinder member for sliding movement between a first retracted position and a second extended position and to permit rearward angular movement upon impact of an object on said piston member of said goal post.

19. The sports goal of claim 18, further comprising an annular cylindrical protective sheath disposed in surrounding relation around said piston member of said goal post.

20. The sports goal of claim 19, wherein said ground contacting base, said goal frame, and said first and second support arms are made from substantially rigid slightly flexible plastic material.

* * * * *